US006253680B1

(12) United States Patent
Grubelich

(10) Patent No.: US 6,253,680 B1
(45) Date of Patent: Jul. 3, 2001

(54) DIVERSIONARY DEVICE

(75) Inventor: Mark C. Grubelich, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/256,812

(22) Filed: Feb. 24, 1999

Related U.S. Application Data

(60) Provisional application No. 60/075,841, filed on Feb. 24, 1998.

(51) Int. Cl.[7] ..... F42B 3/00; F42B 12/46

(52) U.S. Cl. ..... 102/334; 102/336; 102/363; 102/502

(58) Field of Search ..... 102/334, 363, 102/502, 336

(56) References Cited

U.S. PATENT DOCUMENTS

| | | | | |
|---|---|---|---|---|
| 4,947,753 | | 8/1990 | Nixon, III | 102/487 |
| 5,147,975 | * | 9/1992 | Munach et al. | 102/363 |
| 5,259,318 | * | 11/1993 | Alker et al. | 102/334 |
| 5,351,623 | | 10/1994 | Kissel et al. | 102/498 |
| 5,627,338 | * | 5/1997 | Poor et al. | 102/361 |
| 5,654,523 | | 8/1997 | Brunn | 102/498 |

OTHER PUBLICATIONS

Jolly Roger "Bomb Instructions".
Kurd von Haken, *Fliergerbombe fur Kohlenstaubexplosionen—Aug. 30, 1939.*

* cited by examiner

*Primary Examiner*—Peter A. Nelson
(74) *Attorney, Agent, or Firm*—George H Libman

(57) ABSTRACT

A diversionary device has a housing having at least one opening and containing a non-explosive propellant and a quantity of fine powder packed within the housing, with the powder being located between the propellant and the opening. When the propellant is activated, it has sufficient energy to propel the powder through the opening to produce a cloud of powder outside the housing. An igniter is also provided for igniting the cloud of powder to create a diversionary flash and bang, but at a low enough pressure to avoid injuring nearby people.

22 Claims, 7 Drawing Sheets

DIVERSIONARY DEVICE

CROSS REFERENCE TO RELATED APPLICATIONS

This application claims under 35 U.S.C. §119(e) the benefits of Provisional Application S.N. 60/075,841 of Mark Grubelich, filed Feb. 24, 1998.

STATEMENT OF GOVERNMENT INTEREST

The United States Government has rights in this invention pursuant to Department of Energy Contract No. DE-AC04-94AL85000 with Sandia Corporation.

BACKGROUND OF THE INVENTION

This invention relates to diversionary devices used in a wide variety of military, law-enforcement, training and demonstration scenarios. More particularly, it is implemented as a device that is used to produce a disorienting flash of light and a loud noise to temporarily incapacitate or disorient adversaries without inflicting permanent damage.

In situations where a perpetrator is holding a hostage, rescuers use diversionary devices to disorient and distract the perpetrator for a few seconds while they approach and control the perpetrator. It is important that the diversionary device not injure the perpetrator, for the hostage would also be injured by such a device. It is also important that the device produce a bright flash of light, and a loud output of noise, and minimal smoke, as smoke may mask the perpetrator from incoming law enforcement personnel for a sufficient period of time for the perpetrator to recover from the effects of the device. It is also desirable that the device not damage property within the room, and that it be relatively safe when being transported and stored.

An early diversionary device used by the U.S. Government was based on an M116A1 hand-grenade simulator to which an M201 fuze assembly was added. The M201 fuze was installed in the cardboard body of the M116A1 and a potting compound was used to seal the assembly. The device was not entirely satisfactory because occasional flash-throughs in the fuze assembly led to instantaneous functioning (injuring the user). Other problems included the ejection of the fuze at potentially lethal velocities (potentially injuring the hostage or perpetrator), fires resulting from smoldering cardboard body fragments (damaging the property), and excessive smoke.

This device was redesigned as the Mk141, which featured a smaller charge of flake aluminum and potassium perchlorate flash powder. It produces less smoke and has a molded plastic fuze assembly to eliminate flash-through problems. A small pyrotechnic charge separates the fuze from the main body prior to ignition to prevent high-speed ejection of the fuze by the flash powder. The body is made of fire-retardant foam to eliminate high-density fragments and reduce the probability of fires.

The Mk141 still has a few problems. If the device explodes too close to a person, the contact and near field effects are severe enough to cause fatalities due to overpressure from the blast. In addition, the charge is a class 1.1 explosive which is sensitive to shock, thermal, electrostatic and mechanical ignition stimuli. It must be handled as a destructive device during storage and shipping as it is, effectively, a small bomb.

Several patents have also attempted to address these known problems.

U.S. Pat. No. 5,654,523 of Brunn discloses a stun grenade having a fuse, a cartridge containing an explosive charge in communication with the futse, and a housing defining a longitudinal axis and having an internal cavity for the cartridge. At each end, the housing has a plurality of vents in fluid communication with the cavity for discharging energy released when the explosive charge functions. These vents prevent the housing from being propelled by the blast, even if the device is against a wall. In addition, radial dispersion of the explosive energy from the housing minimizes the force concentrated in any one direction, thereby minimizing the possibility of injury.

U.S. Pat. No. 4,947,753 of Nixon discloses a stun grenade having an elongated grenade body having a hollow interior, an open first end, and a closed second end; an ignitor fuse for creating an ignition spark when activated. The ignitor fuse is attached to and closes the open first end of the grenade body; and an explosive substance is positioned within the interior of the grenade body at the second end for exploding when detonated by a blasting cap type device. A spark sensitive explosive, such as an aluminum-perclorate mixture, may be used instead of smokeless powder if the blasting cap is replaced by an ignition source. The patent teaches varying the size of a charge depending on the circumstances.

U.S. Pat. No. 4,932,328 of Pinkney et al. discloses a reusable stun grenade having a steel housing having a steel tubular body with steel end members brazed to the ends of the tubular body, and a brass collar member received in a threaded central opening in one of the end members for supporting an explosive charge in the housing. At the inner end of the collar member is a cylindrical portion to which a tubular container filled with the explosive charge is attached. A flash hole directs a flash which is produced when the fuse member is activated into the tubular container to ignite the explosive charge.

All of these devices have a common feature that leads to a common problem: their explosive output is caused by an energetic material that has sufficient force that if they go off accidentally while they are in contact with a person, that person's hand, arm and/or life is likely to be lost.

Dust bombs are also well known in the art. For example, German patent 680,483 of von Haken (1939) discloses a bomb consisting of a load of coal dust surrounding a powder and priming device. The bomb is suspended from a parachute and has a first explosive 14 to disburse a cloud of coal dust, and a plurality of igniting explosives 11 carried by satellite parachutes 12' dropped from the main parachute to detonate the cloud. By using multiple ignitors, a larger blast effect is achieved.

Another dust bomb is described by the Jolly Roger, on a number of anti-people, anti-Government internet sites. This bomb utilizes a can of explosives adjacent five pounds of flour to destroy a 2000 cubic feet enclosure.

There is no teaching in either of these devices of using a dust bomb as a non-lethal, non-damaging diversionary device.

SUMMARY OF THE INVENTION

It is an object of this invention to have a diversionary device that produces desirable far-field diversionary effects without high near-field pressures.

It is also an object of this invention to have a diversionary device with reduced near-field overpressure.

It is a further object of this invention to have a device that uses fuel-air combustion.

To achieve the foregoing and other objects, and in accordance with the purpose of the present invention, as embodied and broadly described herein, the present invention may comprise a housing having a wall with an outside surface and an opposed inside surface surrounding a volume. A propellant is placed in the housing with a sufficient quantity of fine powder. Means for activating the propellant are provided, with the propellant having sufficient energy to expel the powder to produce a cloud of powder outside said housing. Lastly, an igniter ignites the cloud of powder to create a flash and bang.

Additional objects, advantages, and novel features of the invention will become apparent to those skilled in the art upon examination of the following description or may be learned by practice of the invention.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

The safer and more versatile diversionary device of this invention uses a propellant to move a fuel from the device where it mixes with the ambient air and is ignited. The principle of operation is similar to the undesirable ignition of dust in a coal mine or grain elevator explosion. Since this combustion process is more spatially and temporally diff-use than the detonation of a solid explosive, a longer pressure pulse with a slower rise to peak pressure results. The resulting overpressure is several orders of magnitude lower than that of the Mk141, while desired far-field effects of acoustic and visual alarm are preserved.

Figure 1:
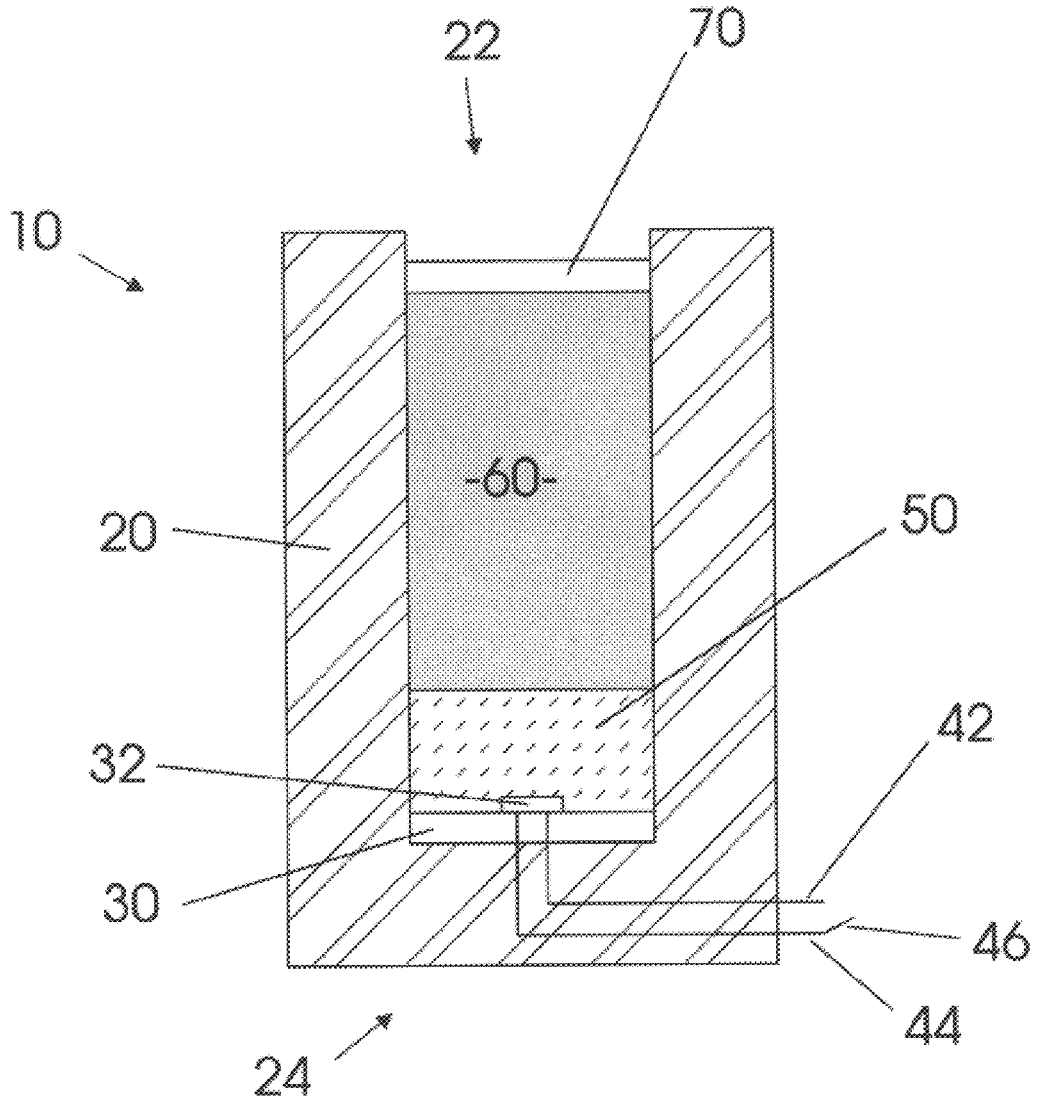
FIG. 1 shows an embodiment of the improved diversionary device.

As shown in FIG. 1, the diversionary device 10 of this invention may include a cylindrical container 20 made of a rigid material such as plastic or metal. Container 20 has an open end 22 and a closed end 24. A substrate 30 is placed at the closed end 24 within container 20. Substrate 30 contains an ignition device such as a semiconductor bridge initiator (SCB) 32 such as taught in U.S. Pat. No. 4,708,060 of Bickes et al, and a firing circuit (not shown) such as taught in U.S. Pat. No. 4,843,964 of Bickes et al. Wires 42, 44 extend from substrate 30 to a switch 46 for activating SCB 32 in a manner well known to those skilled in the art. Of course, any remotely operable ignition source may be utilized in place of SCB 32. Device 10 may also contain additional structure such as shown by U.S. Pat. No. 5,351,623 of Kissel et al which permits device 10 to be armed, and switch 46 closed, after a suitable delay which permits deployment of device 10.

A non-detonating propellant 50 is placed in container 20 over substrate 30 and SCB 32. In this embodiment, propellant 50 is preferably a pyrotechnic such as titanium subhydride potassium percholorate (THKP) or black powder. A pyrotechnic is a mixture of a fuel and oxidizer designed to deflagrate rather than detonate (Deflagrate means a rapid chemical reaction in which the output of heat is sufficient to enable the reaction to proceed and be accelerated without input of heat from another source. Deflagration is a surface phenomenon with the reaction products flowing away from the unreacted material along the surface at subsonic velocity. Deflagration is distinguished from a detonation, which is a violent chemical reaction within a chemical compound or mechanical mixture evolving heat and pressure. A detonation is a reaction that proceeds through the reacted material toward the unreacted material at a supersonic velocity).

A powder 60 extends from propellant 50 towards open end 22 where it is held in place by a cap 70 made of lightweight material such as paper. In operation, propellant 50 is activated by SCB 32 and propels powder 60 out of container 20 through open end 22. As powder 60 disperses into a cloud, it is ignited by device 10 and produces a bright flash and loud noise as it reacts in the atmosphere.

Powder 60 is preferably a fine metal powder. For example, fine aluminum particles have high reactivity in air and good combustion efficiency without being pyrophoric. This is accomplished commercially by passivating aluminum particles to produce a thin inert aluminum-oxide layer while still allowing the underlying aluminum to remain active. However, unlike an energetic material, powder 60 is an inert material in container 20 and poses no danger of fire or explosion while in the container.

The igniter for this embodiment is the hot gases and particles from the pyrotechnic propellant 50 which ignite the cloud to cause a fuel-air explosion.

The amount of propellant 50 and powder 60 that are utilized are critical to this invention. Enough propellant must be provided to expel powder 60 from case 20, but the strength of case 20 and the amount of propellant must be balanced to ensure that case 20 is not fractured into dangerous projectiles by the propellant (to prevent the formation of shrapnel). As defined herein, fracture of the case does not include removing cap 70 or other thin, frangible cover over opening 22 that confines powder 60 until the device is activated. Enough powder must be utilized to form a combustible cloud, but the amount of powder must not be so great as to pose a hazard to people within the target area.

Figure 2:
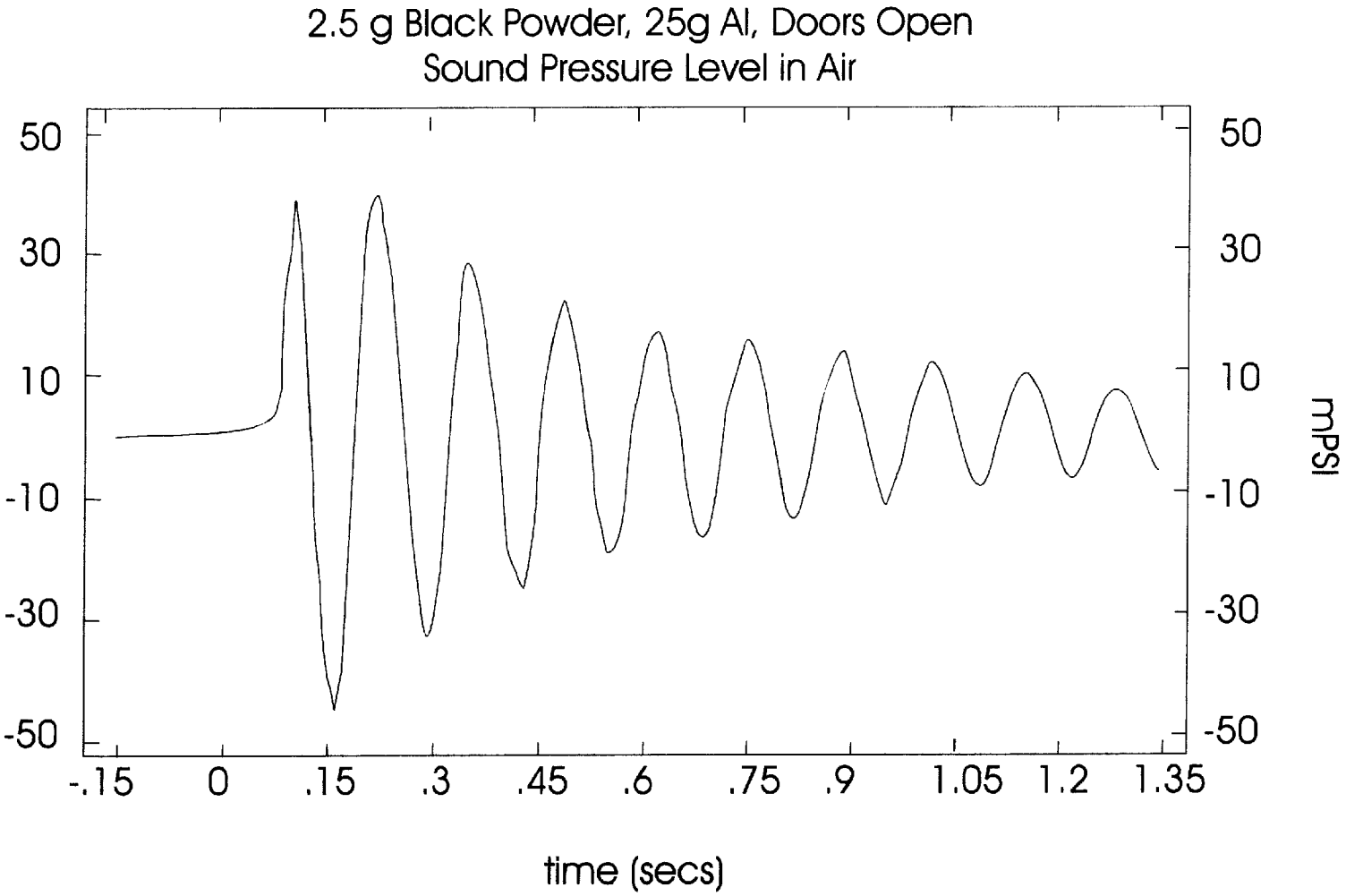
FIG. 2 shows a pressure v. time curve for size of the device of FIG. 1.

Proof of concept has been demonstrated by expelling twenty-five grams of 3 micron aluminum powder (Valimet® H3) from a one inch inside diameter by six inch long tube with 2.5 grams of 4Fg black powder. FIG. 2 shows the sound pressure level in air measured 10 feet from the device. The maximum pressure at that distance is about 0.04 PSI; the maximum pressure at the device was in the range of 10–300 PSI, which would not be permanently disabling should the device accidentally be activated before it is thrown. This corresponds with a maximum pressure of 10K–30K PSI at an MK141, a device which has blown off the hand of people unfortunate enough to be holding it when it prematurely activated.

Figure 3:
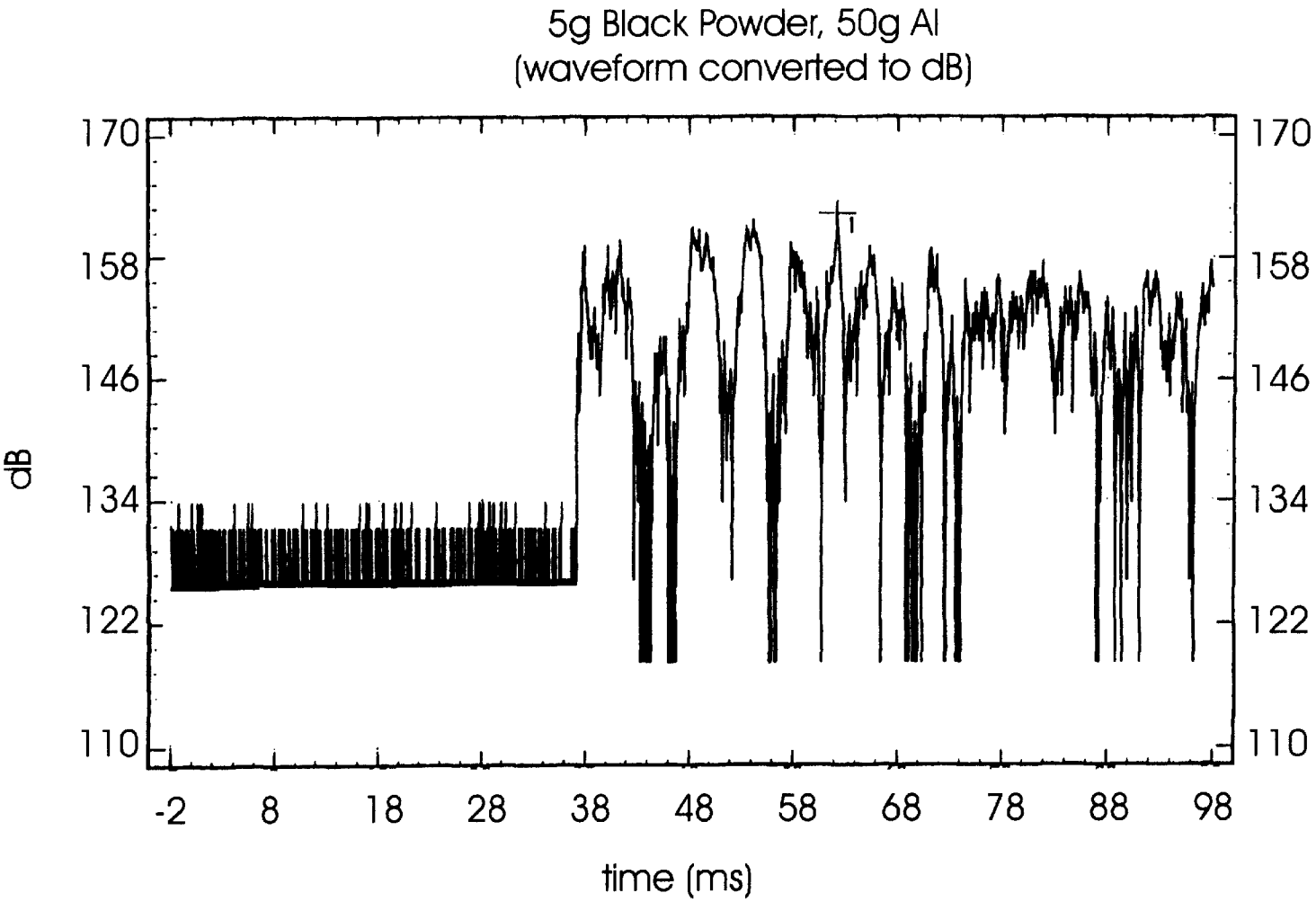
FIG. 3 shows a sound v. time curve for the device of FIG. 2.

FIG. 3 shows the sound pattern, in dB, measured 10 feet from the device described above. This small test device is seen to produce a sustained sound over 120 dB for more than 1 second.

Figure 4:
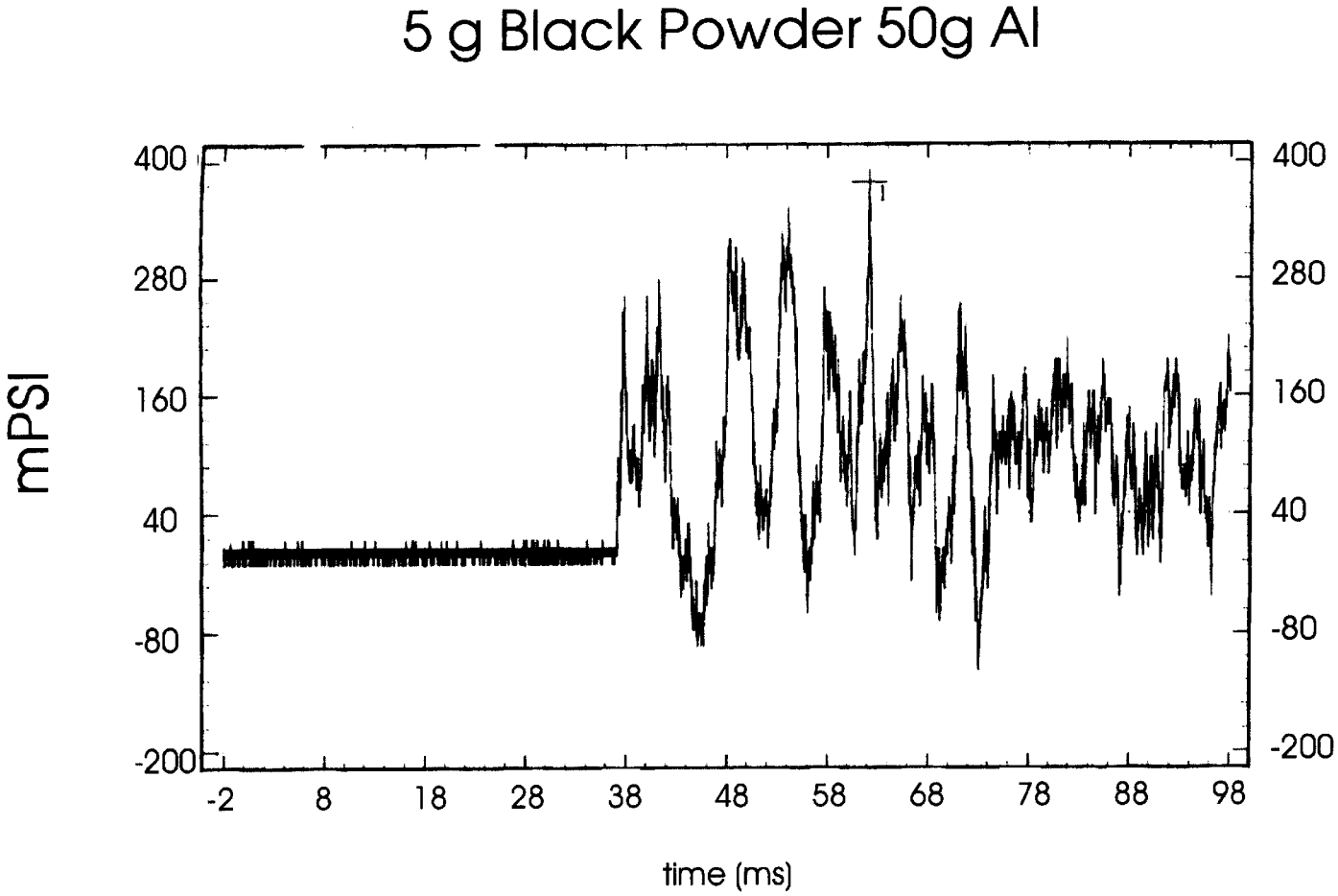
FIG. 4 shows a pressure v. time curve for a larger device of FIG. 1.
Figure 5:
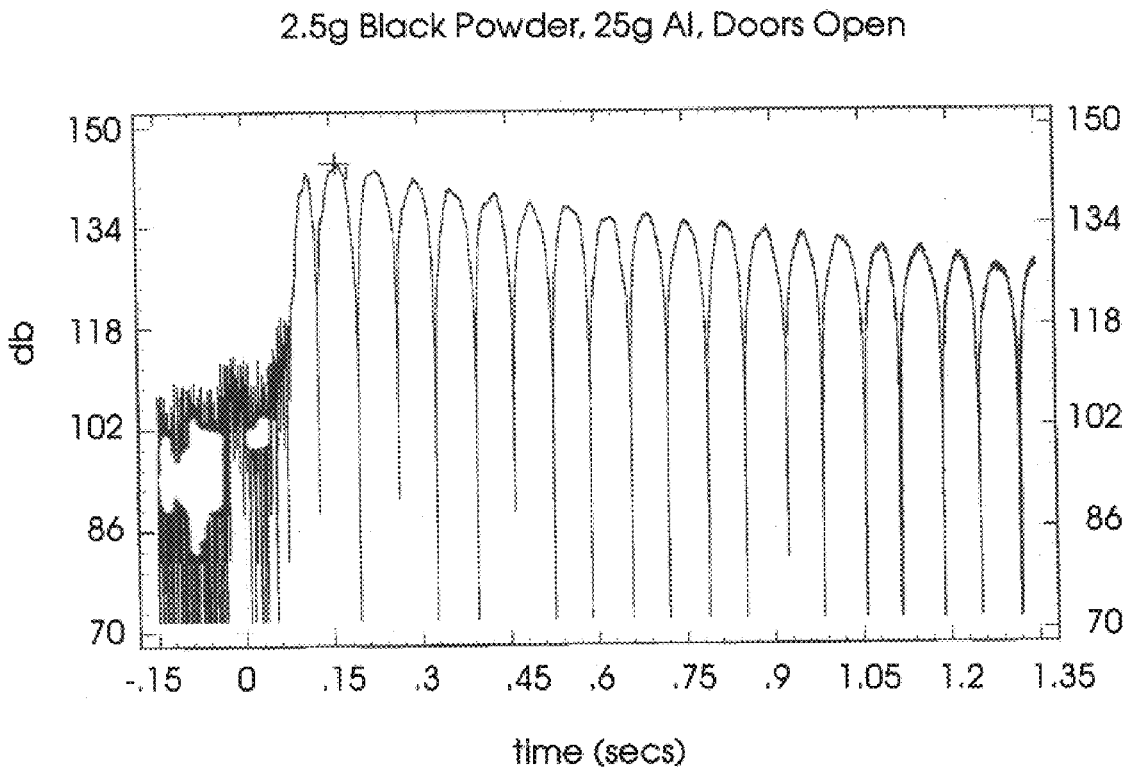
FIG. 5 shows a sound v. time curve for the device of FIG. 4.

The size of the charge was doubled to 5 grams black powder and 50 grams of Al powder and the test repeated. As shown in FIGS. 4 and 5, the maximum pressure at 10 feet rose to 0.2 PSI while the sound increased about 10 dB.

While designed as a test bed for the invention, the electrically initiated embodiment of FIG. 1 could be permanently mounted in a discrete location in the surface of a room that is a possible location of a hostage incident, such as a bank or embassy lobby or the interior of an automobile. If multiple but individually actuated devices are provided for this room, the authorities have the option of varying the size and location of the blast by actuating anywhere from one to many devices simultaneously or in rapid succession.

Of course, the more conventional application of the invention will be as a diversionary device that will be thrown into a room. The outward appearance of such a device is not a significant part of the invention, and FIG. 6 shows a one of many possible embodiments.

Figure 6:
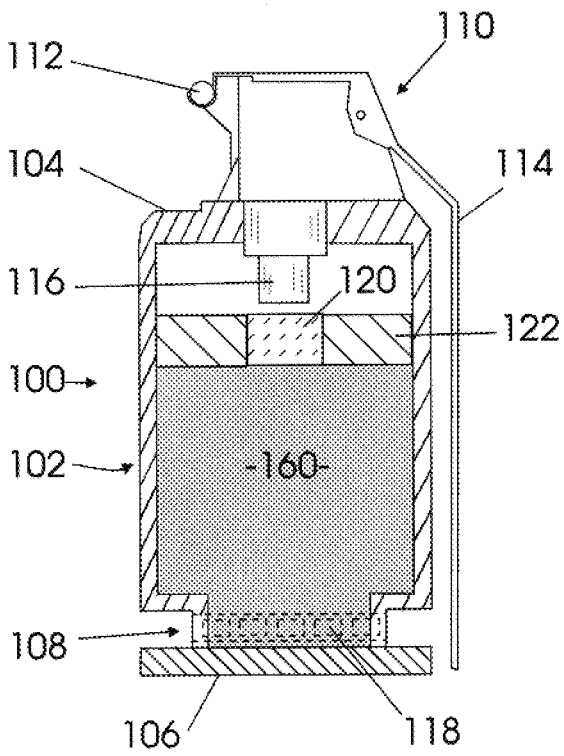
FIG. 6 shows a second embodiment of the invention as a throwable device.

As shown in FIG. 6, diversionary device 100 has a generally tubular case 102 having at one end 104 thereof a conventional grenade-type fuse 110 which includes a pin 112 and a lever 114. Fuse 110 has an output 116 through which a flame is generated after the fuse is activated. A relatively small portion of pyrotechnic material 120 such as black or smokeless powder is mounted in a holder 122 adjacent fuse output 116. The remainder of the interior of case 102 between holder 122 and other end 106 contains a fine powdered non-energetic material 160 such as aluminum or magnesium. A recess 108 in the side wall of case 102 at other end 106 contains a plurality of holes 118 permitting powder 160 to pass through case 102 to mix with outside air. By providing a radial hole pattern, powder 160 is expelled radially and exerts an equal pressure in all directions, thereby reducing the chance that case 102 may be propelled in a potentially dangerous manner as a reaction to the action of the device. Prior to use, a frangible tape (not shown) may be placed over holes 118 to keep powder from 160 from leaking out of case 102.

In operation, pin 112 is removed and lever 114 held in place. When lever 114 is released from the hand of the user, fuse 110 is actuated. After a 1 or 2 second delay, fuse 110 causes a flame to be expelled from output 116. This flame causes pyrotechnic material 120 to deflagrate, producing gases and sparks which propels powder 160 from case 102 through holes 118 (and breaking the frangible tape). A cloud of powder in air forms in the vicinity of case 102. When sparks from deflagrating powder 120 escape through holes 1I18, the cloud rapidly combusts with the bright flash and loud noise as discussed above.

Figure 7:
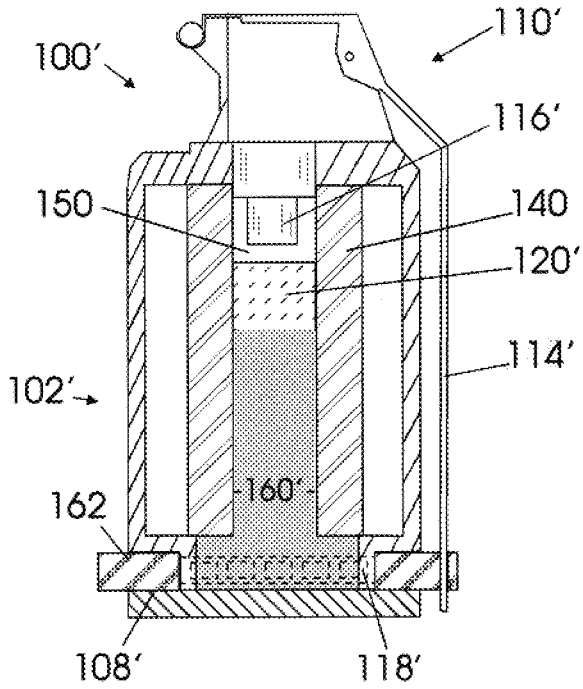
FIG. 7 shows a third embodiment of the invention as another throwable device.

An alternative embodiment is shown in FIG. 7 which has a similar housing and fuse as the embodiment of FIG. 6, but has a reduced volume within housing 102' to contain a smaller amount of powder 160' and, therefore, produce a lesser effect than the previous embodiment. A tube 140 within housing 102' has an internal diameter which surrounds a fractional volume 150 of the total volume contained within housing 102'. This volume 150 contains output 116' of fuse 110', pyrotechnic material 120', and powder 160'. An elastomeric ring 162 fills recess 108' and prevents handle 114' from being released to actuate fuse 110. Ring 162 also serves to seal holes 118' and prevent moisture from entering housing 102', an important consideration for those users who may swim while carrying the device to a hostage situation.

To use the device 100', ring 162 is removed, handle 114' is released (when device 100' is thrown), starting the fusing cycle as discussed previously. The smaller amount of powder 160' is propelled from case 102' by propellant 120' and ignited, resulting in a smaller effect than in the previous example.

As will be appreciated by those who use this invention, it offers a significant advantage over previous diversionary devices in that powder 160 is an inert material until it is dispersed in a cloud. Accordingly, the user may safely remove base 106 and pour out a portion of powder 130 if it is desired to reduce the effect of the device for a particular situation. If housing 102 is made strong enough, and propellant 120 is properly sized, then an accidental discharge of the device cannot cause housing 102 to fracture and send flying pieces into the user's hand or body.

The embodiments of FIGS. 6 and 7 have a potential disadvantage in a prison application where the relatively heavy housing could become a weapon if a used device is obtained by inmates. Accordingly, the embodiment of FIG. 8 prevents that occurrence.

Figure 8:
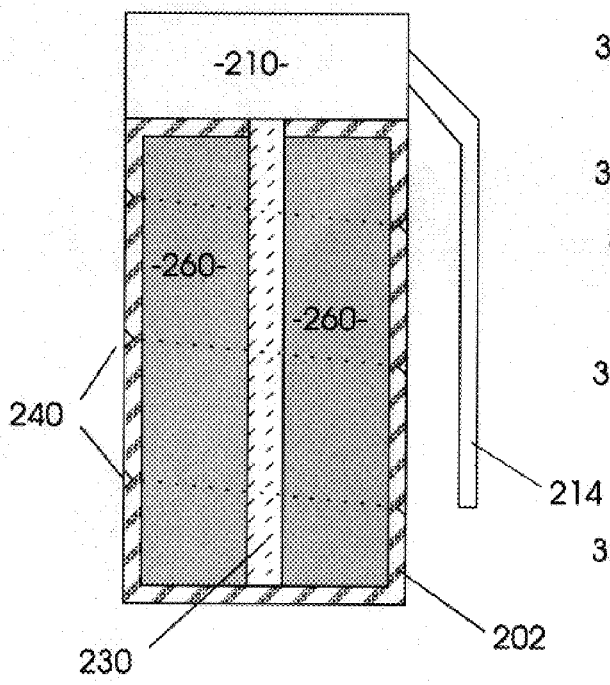
FIG. 8 shows a fourth embodiment of the invention having a frangible case.

As shown in FIG. 8, a hollow housing 202 may have any shape and contains an aluminum or other inert powder as discussed above. A propellant 220 is also placed within housing 202, with powder 260 preferably being between propellant 220 and the inner wall of housing 202. A conventional fuze is provided to activate this embodiment in a manner similar to the previous embodiments.

Housing 202 may be made either of a waterproof fire-retardant foam, such as the body of the Mk141 discussed above, or a frangible lightweight plastic that is weakened with scratches or similar indentations 240. When activated, the internal pressure causes housing 202 to rupturel along the indentations, and powder 260 is expelled through these openings where it is actuated as described above. Preferably, such indentations 240 permit housing 202 to split and open in a manner similar to a clamshell without forming multiple pieces.

Many modifications of this invention are contemplated. The disclosed fuse in FIGS. 6 and 7 was copied from the aforementioned Brunn patent; however, any fuse of a type normally employed with hand grenades that ignites a flammable or explosive material in response to a mechanical or other input could be utilized with the invention. Similarly, while housing 102 is illustrated as generally tubular, any hollow shape may be utilized as long as it has an opening or openings for powder 130, or other material as discussed below, to pass. For example, the housing could be spherical for accurate throwing, with radial holes for dispensing the powder and the propellant near the center surround by powder.

There are also many choices for material which forms the fuel-air cloud that is ignited. Many fine metal or organic powders, or combinations of materials, may be utilized.

Furthermore, there are many choices for propellant of the invention. Although a high explosive such as dynamite should not be used because its detonation would destroy the housing and create dangerous shrapnel, any low explosive of sufficient strength to remove the powder or other material may be utilized in the practice of the invention. Black powder is an example of such low explosive.

Figure 9:
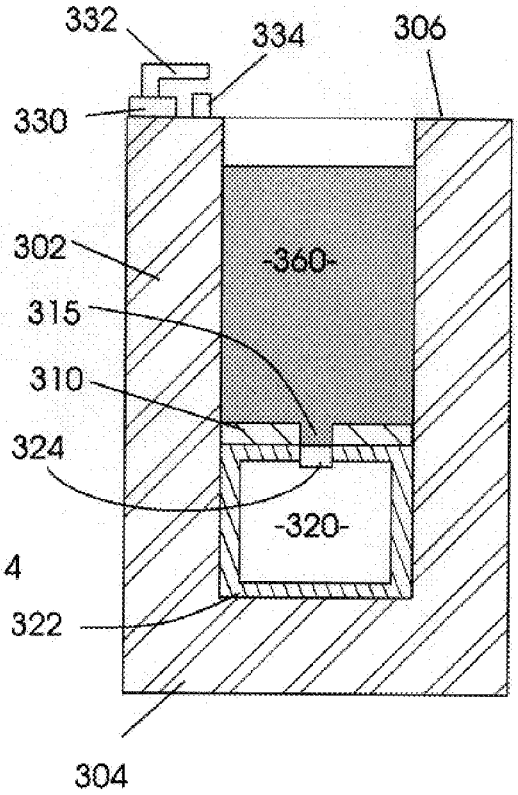
FIG. 9 shows a fifth embodiment of the invention having a stored gas propellant.

FIG. 9 shows a different embodiment of the invention having a generally tubular case 302 with one closed end and an opposed open end 306. A shelf 310 spaced across the interior of case 302 holds a powder or equivalent fuel-air material 360 adjacent open end 306. A compressed gas canister 322 containing $C0_2$ or similar material 320 is placed under shelf 310 between material 360 and closed end 304.

A spark gap device 330 is mounted on case 302 adjacent open end 306. Spark gap device 330 is connected to a source of power through a normally open electric switch in a manner well known in the art.

To operate this embodiment, canister 322 is actuated by any standard technique to release the compressed gas 320 through canister opening 324, through an opening 315 in shelf 310, and into material 360 which is rapidly blown out of case 302 to form a cloud. At this time, spark gap device 330 is actuated, causing a spark to jump from high voltage electrode 332 to spaced electrode 334 and igniting the cloud of material expelled from housing 302.

The particular sizes and equipment discussed above are cited merely to illustrate a particular embodiments of this invention. It is contemplated that the use of the invention may involve components having different sizes and shapes as long as the principle defined by the invention, using a small fuel-air explosion as a diversionary device, is followed. The invention is defined by the claims appended hereto.

What is claimed is:

1. A diversionary device comprising:

a housing having a wall with an outside surface and an opposed inside surface surrounding a volume;

a non-explosive propellant within said housing;

a sufficient quantity of fine powder packed within said housing, said powder being inert in said housing;

means for activating said propellant; said propellant having sufficient energy to expel said powder from said housing said powder producing a cloud of powder outside of and adjacent said housing; and an igniter for igniting said cloud of powder to create a fuel-air explosion.

2. The diversionary device of claim 1 wherein said housing is generally tubular and has two opposed ends, said propellant being adjacent a closed first end; said powder being expelled through an opening adjacent a second end.

3. The diversionary device of claim 2 wherein said opening is in said second end.

4. The diversionary device of claim 2 wherein said opening extends around a portion of said housing wall adjacent said second end.

5. The diversionary device of claim 4 wherein the radius of said housing is less for the portion of said wall contain said opening than the remainder of said housing.

6. The diversionary device of claim 1 wherein the propellant consists of deflagrating means for expelling the powder through said opening without deforming said housing.

7. The diversionary device of claim 6 wherein said deflagrating means is black powder.

8. The diversionary device of claim 6 wherein said igniter consists of said deflagrating means.

9. The diversionary device of claim 8 wherein said means for activating said deflagrating means is remotely initiated.

10. The diversionary device of claim 9 wherein said means for igniting is an SCB.

11. The diversionary device of claim 1 wherein the propellant consists of a compressed gas.

12. The diversionary device of claim 11 wherein the gas is $CO_2$.

13. The diversionary device of claim 11 wherein said igniter is a spark gap adjacent said opening.

14. The diversionary device of claim 1 further comprising said housing being frangible and said powder being between said inside surface and said propellant; wherein said propellant expels said powder by forcing openings in the housing when the device is actuated.

15. The diversionary device of claim 14 wherein said housing is scored with weak spots so the openings occur at predetermined locations.

16. The diversionary device of claim 15 wherein said housing is scored so that the housing will not fragment into separate pieces.

17. The diversionary device of claim 14, said housing being formed of a low density material.

18. The diversionary device of claim 17 wherein said housing is fire-retardant foam.

19. The diversionary device of claim 18 wherein said housing is waterproof.

20. The diversionary device of claim 14 wherein said housing is waterproof.

21. The diversionary device of claim 1 wherein said powder is a fine metal or organic powder.

22. The diversionary device of claim 21 wherein said powder is aluminum.

* * * * *